US006493421B2

(12) United States Patent
Gutman

(10) Patent No.: US 6,493,421 B2
(45) Date of Patent: Dec. 10, 2002

(54) APPARATUS AND METHOD FOR GENERATING A HIGH INTENSITY X-RAY BEAM WITH A SELECTABLE SHAPE AND WAVELENGTH

(75) Inventor: George Gutman, Birmingham, MI (US)

(73) Assignee: Advanced X-Ray Technology, Inc., Bloomfield Hills, MI (US)

( * ) Notice: Subject to any disclaimer, the term of this patent is extended or adjusted under 35 U.S.C. 154(b) by 0 days.

(21) Appl. No.: 09/974,255

(22) Filed: Oct. 9, 2001

(65) Prior Publication Data

US 2002/0064253 A1 May 30, 2002

Related U.S. Application Data

(60) Provisional application No. 60/240,559, filed on Oct. 16, 2000.

(51) Int. Cl.[7] ..... G21K 1/06
(52) U.S. Cl. ..... 378/84; 378/88
(58) Field of Search ..... 378/84, 88

(56) References Cited

U.S. PATENT DOCUMENTS 5,153,900 A 10/1992 Nomikos et al.
5,369,679 A 11/1994 Sliski et al.
5,420,905 A * 5/1995 Bertozzi ..... 378/88
5,422,926 A 6/1995 Smith et al.
5,428,658 A 6/1995 Oettinger et al.
5,528,652 A 6/1996 Smith et al.
5,551,587 A 9/1996 Keppel et al.
5,566,221 A 10/1996 Smith et al.
5,646,976 A 7/1997 Gutman
5,799,056 A 8/1998 Gutman
6,014,423 A 1/2000 Gutman et al.
6,041,099 A 3/2000 Gutman et al.
6,249,566 B1 * 6/2001 Hayashi et al. ..... 378/85
6,280,906 B1 8/2001 Braat et al.
6,295,334 B1 * 9/2001 Toyota ..... 378/84

OTHER PUBLICATIONS

Gutman Optics, Osmic Inc., "A New Family of Collimating and Focussing Optics For X–Ray Analysis".
MSC Blue Confocal Optics, "What Are Confocal Maxflux Optics?", p. 1–10, Nov. 8, 1999.
Ir. J. Verhoeven, "An Electron–Accelerator–Based Table–Top Soft X–Ray Source", Jul. 12, 2001.
X–Ray Generators, FR591 Rotating Anode X–Ray Generator, Nonius BV, 1998, 1999, 2000.
Osmic's New Developments, "What's New At Osmic", 1999.
Max–Flux Optic, p. 1–3, 1999.
Max–Flux Optical Scheme, p. 1–2, 1999.

* cited by examiner

*Primary Examiner*—Drew A. Dunn
*Assistant Examiner*—Irakli Kiknadze
(74) *Attorney, Agent, or Firm*—Brooks & Kushman P.C.

(57) ABSTRACT

An X-ray source is provided for delivering a high intensity X-ray beam with a predefined energy level of monochromatization, intensity and spatial distribution to a desired region of a sample. The source includes a linear accelerator with a thin anode 4, an electron trap 5 for separating an electron beam from an X-ray beam and conditioning optics which direct, shape and monochromatize the X-ray beam. The conditioning optics include a housing 8 within which are contained entrance slits, multi layer Kirkpatrick-Baez mirrors, exit slits, and a stop diaphragm. The invention also include a method of generating X-rays and a method of using them.

13 Claims, 2 Drawing Sheets

APPARATUS AND METHOD FOR GENERATING A HIGH INTENSITY X-RAY BEAM WITH A SELECTABLE SHAPE AND WAVELENGTH

CROSS-REFERENCE TO RELATED APPLICATIONS

This application claims the benefit of a provisional patent application Serial No. 60/240,559, filed on Oct. 16, 2000.

BACKGROUND OF THE INVENTION

1. Field of the Invention

The present invention relates to movable X-ray sources for delivering to an object of interest a conditioned, monochromatic, high intensity X-ray beam.

2. Background Art

Conventional X-ray sources exist that deliver low energy (usually less than 150 keV) X-ray radiation (hereinafter "X-rays", "X-ray beams", or "X-ray radiation") to an object or target. Such conventional sources are exemplified by a sealed X-ray tube and an X-ray tube with a rotating anode. There are also X-ray sources containing X-ray tubes which are attached to conditioning (e.g., collimating or focusing) optics. However, such conventional approaches leave unsolved the challenge of delivering a conditioned, monochromatic beam with a high intensity.

To bring high intensity X-ray radiation to a relatively small object by a narrow focusing or collimating beam or by a beam with a limited angular aperture, conventional X-ray sources have certain disadvantages:

1. Low efficiency (about 0.2%), i.e., the ratio of output energy emitted as X-rays to the input energy associated with incident electrons; and
2. Unfavorable spatial distribution. In an X-ray tube, the spatial distribution of X-rays emitted from a thick anode is spherical. For an angular aperture (for example, less than 0.6×0.6 degrees), only a small fraction of the emitted X-rays can be used.

An example of systems having an angular aperture of 0.6×0.6 degrees is Gutman Optics, available from Osmic, Inc. of Troy, Mich. Such a system is described in a product brochure entitled "Gutman Optics," which is incorporated by reference herein.

Various X-ray sources are used in several applications. X-ray tubes with an energy below 150 keV emit radiation that is distributed omnidirectionally with a polychromatic spectrum and narrow characteristic lines. Such tubes are often used in the industrial environment, e.g. in analytical instrumentation, non-destructive testing, and for similar applications. These X-ray sources are typified by a low intensity of the generated X-ray beam. Megavoltage X-ray tubes with a transmitting-type target, (so-called linear accelerators) emit a directed high intensity polychromatic beam. Linear accelerators are used in X-ray security/inspection systems and in medical applications, such as radiation therapy. Their effectiveness, however, is limited because the highest intensity of the directed polychromatic X-ray radiation is delivered by the high energy (more than 1 MeV) part of the spectrum with high penetration that, in turn, can damage healthy tissue. Additionally, such radiation sources require heavy shielding systems and large power supplies. These requirements, in turn, mandate separate facilities for their accommodation.

SUMMARY OF THE INVENTION

By combining a linear accelerator having a thin anode and an electron trap and conditioning optics, the disclosed invention creates and delivers a high intensity monochromatic X-ray beam in a region of energy comparable to X-ray tubes and with an intensity comparable to that of a conventional linear accelerator. The electron trap contains a strong magnet for deflecting a high energy electron beam that penetrates a thin anode. The invention also provides a cell with a material that absorbs high energy electrons and ensures separation between the emergent X- rays and electron beams.

Due to the thin anode, high energy X-ray scattering, especially in a direction divergent from the optical axis, is decreased by several orders of magnitude. This simplifies the provision of a shielding system, while creating a movable high intensity X-ray source. In medical applications, for example, such a type of X-ray source can be used in the operating room while significantly decreasing the cost of treatment.

It is an object of the present invention to provide a moveable X-ray source that has an X-ray linear accelerator with a thin anode and conditioning optics for delivery to an object of a high intensity, monochromatic X-ray beam having a selectable shape and wavelength.

It is a further object of the invention to provide an electron trap for separating a high energy electron beam transmitted through an anode from an X-ray beam that emerges from the anode, while absorbing the electron beam to prevent high energy X-ray scattering.

It is still further an object of the invention to provide an optical housing constructed from a thick, heavy metal (such as lead or tantalum) that serves as a barrier to penetration by high energy X-rays.

It is still another object of the invention to provide with the above-mentioned optics, a stop diaphragm in the form of a thick, heavy metal diaphragm that prevents direct elimination of the object by any X-ray radiation, including high energy X-ray radiation.

It is yet further an object of the invention to provide slits and a stop diaphragm such that the inner surfaces of the slits and the outer surface of the diaphragm remain parallel to the edge of the X-ray beam.

Additionally, it is an object of the invention to provide a method and system that does not require a vacuum in which to operate.

Additionally, it is an object of the invention to provide a method and system which does not depend primarily on the material of the target used.

DETAILED DESCRIPTION OF THE PREFERRED EMBODIMENTS

Figure 1:
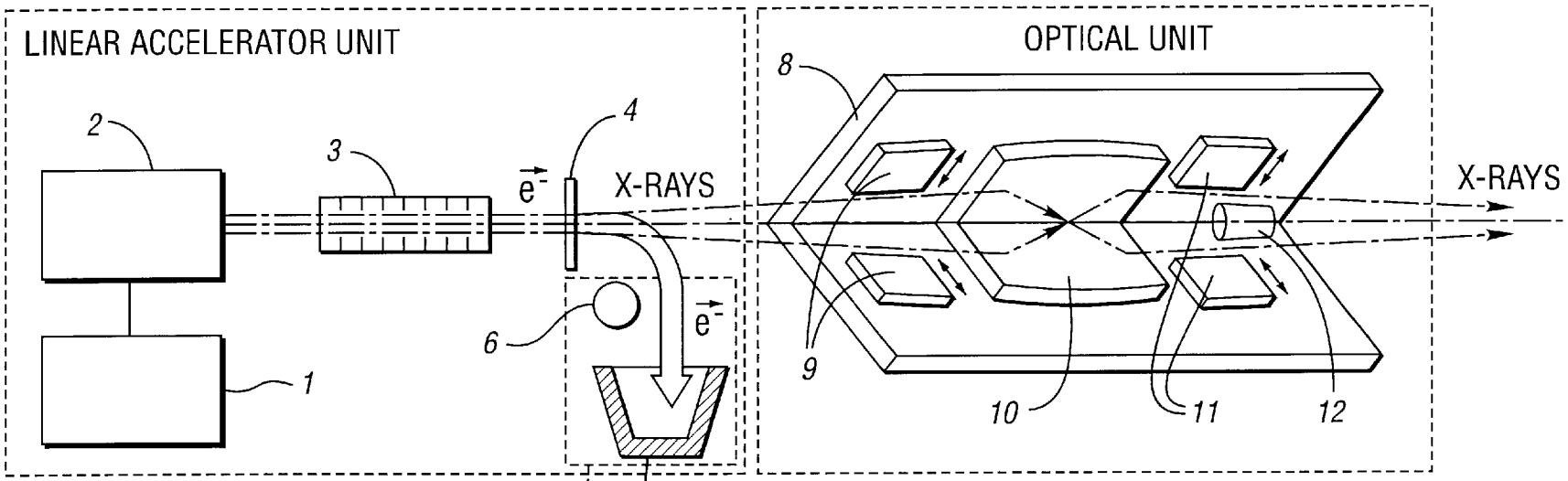
FIG. 1 is a schematic illustration of the X-ray source of the subject invention, including a linear accelerator with a power supply, an electron gun, an accelerator tube, a thin metal target, and an electron trap; and an optical unit with slits, Kirkpatrick-Baez laterally graded, multilayer mirrors in a housing, a stop diaphragm, and an emergent monochromatic X-ray beam.

An embodiment of the disclosed X-ray source is depicted in FIG. 1. The X-ray source includes two units: a linear accelerator and an optical unit. The linear accelerator includes a power supply 1, an electron gun 2, an accelerator tube 3, a thin (i.e. less than 50 microns) metal target (anode) 4, and an electron trap 5, including a power magnet 6 and an absorbing cell 7. The thickness of the thin metal target (anode) 4 depends on the desired application.

The components of the optical unit are arranged in a metal housing 8. The optical housing 8 is built from a heavy metal (lead, tantalum, etc.) and serves as a shielding for high energy X-rays transmitted through the multilayer mirrors 10. These components include an entrance slit 9, conditioning optics 10 (depicted as focusing optics), exit slit 11, and a stop diaphragm 12. The inner surface of the slit 9 and the outer surface of the stop diaphragm 12 remain parallel to the edge of the X-ray beam. In FIG. 1, the slits 9 and stop diaphragm 12 prevent irradiation of an object or target by an unfavorable high energy X-ray beam. Point focus of the X-ray beam ties in focal plane of the optics.

The electron beam emitted from the electron gun 2, accelerates, for example up to 15 MeV in accelerator tube 3, and becomes incident on the thin metal target 4. From the opposite side of the target, X-ray radiation (a spectrum, shown in FIG. 2) is emitted and a flux is transmitted through the target 4 of high energy electrons. The electron trap 5 separates X-rays moving along the optical axis from high energy electrons. The electron flux is deviated by the magnet 6 and directed to the absorption cell 7. The electron trap 5 prevents irradiation of the metallic parts of the X-ray source by the high energy flux of electrons and thereby avoids unfavorable scattering of X-ray radiation.

Figure 3A:
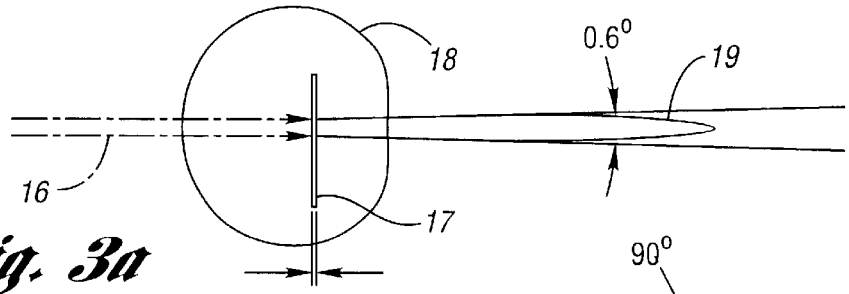
FIG. 3*a* schematically portrays the spatial distribution of X-rays around a thin transmitting-type target of a linear accelerator.

In FIG. 3*a,* the reference numeral 16 identifies a parallel electron beam 16 with an electron energy of 15 MeV that is incident upon a thin (10 microns) target 17. The spatial distribution of Bremsstrahlung X-rays 19 with an energy below 150 keV is depicted. The spatial distribution of X-rays, 19 is shown where the energy of incident electronics is 15 MeV.

Figure 3B:
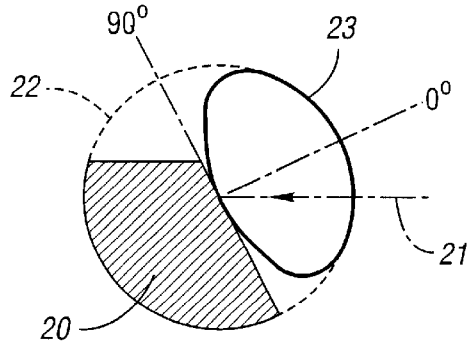
FIG. 3*b* schematically illustrates the spatial distribution of X-rays around a thick target (e.g. an X-ray tube)

In FIG. 3*b,* an electron beam 21 is shown that becomes incident upon a metallic target 20. The spatial distribution of X-rays that are emitted from the target is identified with the reference numeral 22. The reference numeral 23 depicts the spatial distribution of X-rays emitted from an X-ray tube with the X-rays being absorbed by the target material.

Figure 4:
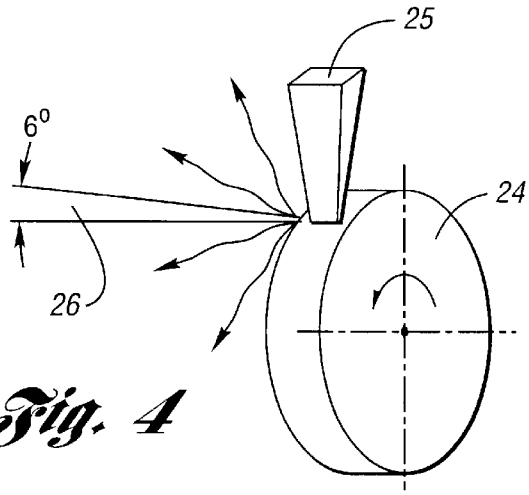
FIG. 4 depicts the incidence of an electron beam upon a rotating anode and the take-off angle of an X-ray beam.

In FIG. 4, an electron beam 25 becomes incident upon a rotating anode 24. The take-off angle of emergent X-rays is depicted by the reference numeral 26.

Figure 2:
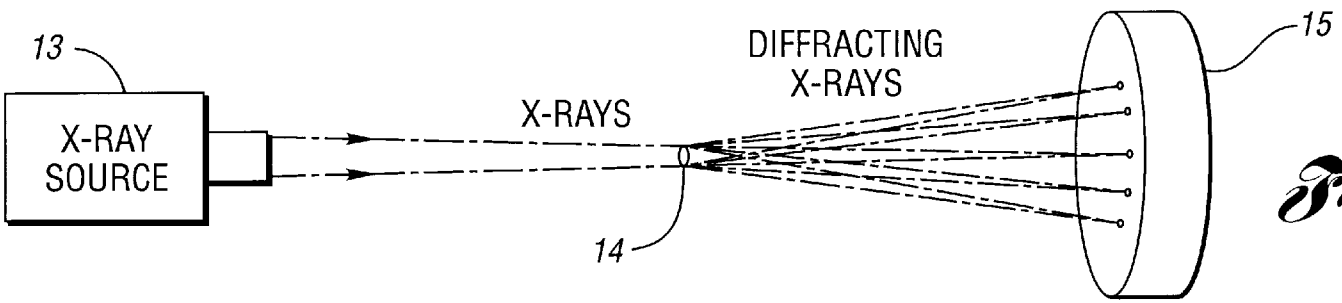
FIG. 2 is a schematic illustration of an X-ray diffractometer where an X-ray beam emitted from the inventive X-ray source irradiates an object that is placed in front of a detector where the detector is placed in the focal plane of the diffracted beam.

In the optical unit, X-rays are reflected from two, for example, elliptical, laterally graded multilayer mirrors mounted "side by side" in a Kirkpatrick-Baez optical configuration. The X-ray beam is reflected in accordance with Braggs' Law and is focused on the sample or on the surface of the detector 15 (FIG. 2). The diffracted beam is monochromatic, with a half-value width (FWHM) that is defined by the parameters of multilayer mirrors. ($\Delta E$ in FIG. 5). Changing the parameters (e.g., d-spacing, gamma, number of layers, etc.) of the elliptical, laterally graded multilayer mirrors varies the FWHM of the reflected X-ray beam. A more detailed description of the conditioning optics is given in the Gutman Optics brochure, which was earlier incorporated by reference. A similar arrangement is depicted in U.S. Pat. No. 6,014,423, which issued on Jan. 11, 2000. That patent is also incorporated herein by reference. It describes laterally graded, multilayer X-ray mirrors bent in an elliptical or a parabolic cylindrical shape.

It is known that a "side-by-side" Kirkpatrick-Baez optical configuration (MUX-FLUX) of Osmic, Inc., Troy, Mich. employs two Gutman Optics mirrors and is used in X-ray diffractometry. This configuration simultaneously monochromatizes and collimates or focuses divergent radiation from an X-ray source, for example, an X-ray sealed tube or X-ray tube with a rotating anode. Parabolic mirrors generate a parallel beam that is used in high resolution diffraction and protein crystallography. Elliptically curved mirrors focus the divergent radiation to a small spot at the detector in order to increase intensity and improve resolution. The high brilliance and small dimension of the focus beam lends itself to the biotechnology and the semiconductor industries, for example.

The X-ray source of FIG. 1 may be used as an X-ray source 13 of a conventional X-ray diffractometer (FIG. 2), such as that designed and manufactured for use in protein crystallography. The cross-section of the beam impinging on a region of a sample 14 is less than 0.4 mm (the sample size is 0.3 mm or less). On the surface of a position-sensitive detector 15, there is a diffraction pattern which is used to find the structure of an investigated molecule. Due to insufficient flux density (delivered power) impinging on the sample 14, the time required for one analysis of the protein crystal is at least 24 hours. To decrease the time of analysis, one could increase the detector sensitivity but the detector's sensitivity may already be set close to its limit, or increase the flux delivered to the sample.

Thus, the X-ray source of the present invention combines a modified (thin anode 4, electron trap 5) linear accelerator with conditioning optics. This combination produces X-rays with a user-selectable (parallel, focusing or divergent) shape, and a variable monochromatic wavelength. Together with suitable shielding, this X-ray source can operate satisfactorily in a laboratory environment.

There are two different mechanisms by which X-rays are produced: "Bremsstrahlung" ("braking radiation") X-rays, and "characteristic" X-rays. The present invention harnesses Bremsstrahlung X-rays, which result from radiative collision or interaction between a high-speed electron and a nucleus. It is known that the electron, while passing near a nucleus, may be deflected from its path by the action of Coulomb forces of attraction and lose energy as Bremsstrahlung. As the electron with its associated electromagnetic field passes in the vicinity of a nucleus, it suffers a sudden deflection and acceleration. Consequently, a part or all of its energy is dissociated from it and propagates in space as electromagnetic radiation. The resulting Bremsstrahlung photon stream may have any energy up to the initial energy of electron. Bremsstrahlung X-rays have a continuous spectrum.

"Characteristic" X-rays are produced when an electron interacts with the atoms of the target (anode) and ejects an orbital electron, leaving the atom ionized and creating a vacancy in an orbit. Then an outer orbital electron falls down to fill a vacancy. In so doing, energy is radiated in the form of electromagnetic radiation. This is termed "characteristic radiation", which unlike Bremsstrahlung, is emitted at discrete energies that have a discrete spectrum.

Characteristic X-rays are emitted equally in all directions. The direction of emitted Bremsstrahlung X-rays depends on the energy of the incident electrons. Below an electron energy of about 150 keV, X-rays are also emitted equally in all directions (FIG. 3*a*). On the right hand side of FIG. 3*a,* there is an illustration of the spatial distribution of X-rays where the energy of the electrons is about 15 MeV. As the kinetic energy of the electrons increases, the direction of X-ray emission becomes directed increasingly forwardly.

In megavoltage X-ray accelerators, electrons bombard the transmission-type target from one side and the X-ray beam is obtained on the other side of the target. For thin (about 10 microns) targets, even the low energy (from 10 keV to 110 keV) part of megavoltage Bremsstrahlung flux is strongly oriented along the optical axis of the accelerator. By using conditioning optics, the relatively narrow pattern of the continuous spectrum may be cut off, thereby producing a required level of monochromatizaton.

In applications where a narrow parallel or focusing beam is used or where a small sample is placed apart from the focus of the X-ray source (e.g., in X-ray diffractometry, TXRF spectrometry), and where a small angular aperture of the conditioning optics is used, the disclosed X-ray source provides an increase of intensity compared with conventional X-ray sources.

Another advantage of the linear accelerator used in the disclosed X-ray sources compared to those used in conventional X-ray sources is the higher efficiency of the accelerator. The term "efficiency" is defined as the ratio of output energy emitted as X-rays to the input energy deposited by electrons. The efficiency of X-ray production depends on the atomic number and the voltage applied to the tube. The efficiency of a typical X-ray tube is a fraction of the input energy. The efficiency of X-ray production with a tungsten target (Z=74) for electrons accelerated through 100 keV is less than 1%. The rest of the input energy (about 99%) appears as a heat. In a megavoltage linear accelerator, efficiency can reach 40–60%.

COMPARATIVE EXAMPLE

The present invention deploys with an optical unit a linear accelerator with a thin anode and an electron trap instead of an X-ray tube with a rotating anode. The configuration of the X-ray diffractometer, including optics, is conventional. The same anode material is used for both the X-ray tube and the accelerator.

The flux delivered to the sample in an identical X-ray diffractometry scheme was compared for two different cases: using the best existing X-ray source and the disclosed X-ray source. A conventional X-ray tube with a rotating anode and conditioning optics insured the highest density of monochromatic flux delivered on the sample.

Figure 5:
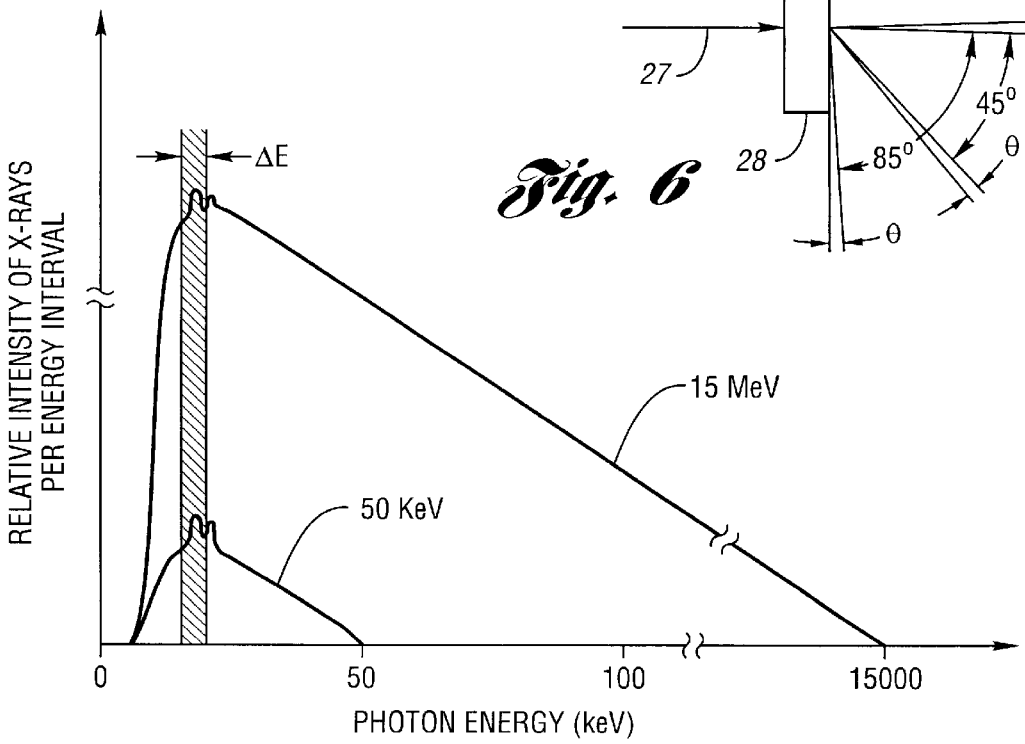
FIG. 5 is a graph of relative intensity of X-rays per energy interval against photon energy.

The physical focus of the X-rays 25 with a rotating anode 24 (FIG. 4) is 0.3 mm×3.0 mm. To achieve 0.3 mm×0.3 mm, the optical axis of the collimator is aligned at 6 degrees (6 degree take-off angle) in relation to a normal line extending from the anode surface (FIG. 4). The angular aperture 26 of the optics used depends on the energy of the reflecting X-ray beam and the parameters of multilayer mirrors. This can vary from 0.3 degrees to 0.6 degrees. The elliptical collimater/monochromator "cuts" the same parts of spectrum ΔE in both cases (FIG. 5).

Computer simulation and comparative calculations of the flux delivered to the sample in an X-ray diffractometer for the best conventional and the disclosed X-ray source has been performed by American Science and Engineering, Inc., (AS&E), Billerica, Mass. GEANT software, Version 3.21 was used for calculation. This software calculates X-ray flux parameters emitted from both X-ray tubes and X-ray accelerators in the region of energies from 10 keV to 25 MeV.

A computer simulation was run for the X-ray sources with the following parameters:

| X-Ray Source | Conventional | Inventive |
|---|---|---|
| Anode | Thick; Mo | 10 microns; Transmitted type Mo |
| Power | 6 kW | 0.5 kW |
| Voltage | $6 \times 10^4$ V | $15 \times 10^6$ V |
| Focus | 0.3 mm × 0.3 mm | 0.3 mm × 0.3 mm |
| Angular Aperture | 0.6 degrees | 0.6 degrees |

For the disclosed X-ray source, the energy (ΔE, FIG. 5) of the X-ray beam which was reflected and received outside the optics was 17 keV<E<18 keV. The characteristic line of molybdenum is about 17.5 keV.

The results obtained by computer simulation were that the flux density generated by the disclosed X-ray source) was 325 times the flux density generated by the conventional X-ray source.

Thus, for an identical power setting, the disclosed X-ray source generated a flux incident upon the sample that was more than three thousand times (325*6 kW/0.5 kW=3900) the flux of a conventional X-ray source with the same X-ray beam parameters: monochromatization, beam convergence, beam size, etc. Accordingly, the time of measurement was shortened from 24 hours to a fraction of a minute. In other words, the disclosed X-ray source delivers flux to a comparatively small region of a sample (such as protein crystal) X-rays with an intensity up to about 4,000 times higher than the intensity of the most advanced existing X-ray sources (i.e. X-ray tubes with a rotational anode coupled with conditioning optics of an identical power).

Figure 6:
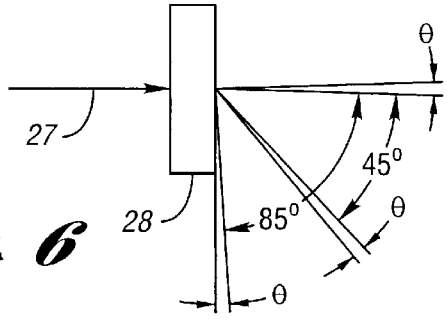
FIG. 6 illustrates the X-ray beam width that emerges at 0, 45, and 85 degrees in relation to an electron beam that becomes incident upon an anode.

Additionally, calculations were performed to compare the spatial distribution (FIG. 6) of the high energy unfavorable "background" energy from a conventional linear accelerator with an anode of 1.0 mm thickness and a linear accelerator with a 0.01 mm (=10 micron) thickness anode, as used in the disclosed X-ray source. All the other parameters of accelerometers compared (besides anode thickness) were identical.

The results derived by computer simulation were:

| Type of Linear Accelerator | Mo Anode Thickness (mm) | Angular Range (degrees) | Calculated Intensity of X-rays (for X-rays with E > 1MeV) |
|---|---|---|---|
| Conventional | 1.0 | $0 < \theta < 5$ | 190,064 |
| Invention | 0.01 | $0 < \theta < 5$ | 54,429 |
| Conventional | 1.0 | $45 < \theta < 50$ | 152,366 |
| Invention | 0.01 | $45 < \theta < 50$ | 24 |
| Conventional | 1.0 | $85 < \theta < 95$ | 18,334 |
| Invention | 0.01 | $85 < \theta < 95$ | 8 |

In the above table, the angle θ measures the beam width that emerges between 0–5 degrees in relation to an incident electron beam, 45–50 degrees, and 85–90 degrees therefrom.

Although the relationship between intensity and anode material and thickness, space distribution of radiation, etc. was calculated only for photon energies higher than 10 keV, e.g. X-ray wavelength about 1.26 Angstroms or less, (minimum permitted power for the known theoretical model), the disclosed X-ray source may generate radiation having a wavelength up to 200 Angstroms. Part of a high energy electron beam will penetrate through the thin target 4 (FIG. 1). A few "outside" atom layers will be irradiated by the electron beam and will emit soft X-rays (up to 200 Angstroms) which will not be absorbed by these few atomic layers. An X-ray source placed in a vacuum can serve as a source for EUV lithography and X-ray ("water window") microscopy.

The high energy unfavorable background for the disclosed X-ray source was low compared with the conventional linear accelerator, except in the most forward direction. Thus, it was possible to decrease the dimensions and weight of shielding, and build a movable/portable X-ray source which could be used in a laboratory environment.

Analytical Instrumentation

The applications of the disclosed invention include but are not limited to X-ray analytical instrumentation, X-ray imaging systems, medical applications, and cancer diagnosis and treatment. For example, an application of the invention as a high intensity, monochromatic X-ray source for delivering a predetermined dose directly to a tumor through needles implanted into the tumor is disclosed in co-pending U.S. Ser. No. 09/776,559, filed on Feb. 2, 2001, which is incorporated by reference. Such a system has the ability to improve control over the dosage of incident radiation delivered to a critical organ, thereby reducing the chance of damage to ambient, healthy organs.

The disclosed X-ray source also can be effectively used in X-ray spectrometry and diffractometry. For example, in Total-Reflection X-ray Fluorescence (TXRF) spectrometers, which are widely used in the semiconductor industry for monitoring wafer surface contamination, there is an improvement in sensitivity, precision, and resolution, with a simultaneous reduction in the time required to conduct these measurements.

The disclosed X-ray source will be effective in diffractometers using a collimating polychromatic beam (e.g. Laue diffraction protein crystallography). Lane diffraction technique is presently used only at large synchrotron facilities, and is not used with conventional X-ray tubes because their intensity is insufficient. By bringing a "synchrotron facility" into the analytical laboratory, the subject invention represents a step toward utilization in protein crystallography, powder diffraction, and in other similar applications.

Other Applications

Such known X-ray imaging techniques as X-ray medical and X-ray industrial computed tomography, as well as other methods of non-destructive testing, are expected to benefit from the disclosed X-ray source.

By expanding the low energy delivery to about 60 eV, the disclosed X-ray source may serve as an efficient radiation source for EUV (formerly called "soft" X-ray) lithography and X-ray microscopy. Lithography is the process by which a beam of light is used to transfer intricate patterns from a mask onto the surface of a material in order to make a device, such as an integrated circuit (microchips). However, the wavelength of light imposes a physical limitation on the dimensions (about 0.18 microns) of microchip elements and the degree of integration. A resolution of 0.05 microns is considered achievable today and can be used for fabricating microchips. Such resolution requires a new source for lithography, with a wavelength at least several times shorter than the wavelength of existing sources.

In summary, the X-ray source according to the disclosed invention generates X-rays having a wavelength between 1.25 Angstroms through 0.1 Angstroms based upon using Bremsstrahlung X-ray emissions in the forward direction (FIG. 3*a*). In contrast, the prior art generates X-rays having a wavelength between 10 Angstroms and 200 Angstroms using Cherenkov radiation. In the disclosed invention, the efficiency and favorable spatial distribution is explained by the physical nature of Bremsstrahlung for a defined anode thickness and in a defined region of the energy of X-rays emitted.

Additionally, the prior art described herein functions only in a vacuum. In contrast, the subject invention does not require a vacuum. Also, prior art approaches typically are material-dependent. In contrast, the subject invention does not depend primarily on the material of target used.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An X-ray source for delivering X-rays along an optical axis with a predefined energy, intensity and spatial distribution to a desired region of a sample, comprising:

a linear accelerator with a thin anode having a thickness less than or equal to about 50 microns that creates a conical spatial distribution characterized by an angle less than of plus or minus 5 degrees in relation to the optical axis for X-rays with an energy below 110 keV and an electron trap that deflects and absorbs an electron beam that penetrates through the thin anode; and conditioning optics which shape, direct and monochromatize the X-rays that emerge from the thin anode by cutting a narrow line from a continuous spectrum in the region of the spectrum below 110 keV.

2. The X-ray source of claim 1 wherein the electron trap includes a magnet for changing the trajectory of electrons penetrating through the anode and a cell made of a material that absorbs the X-ray beam emerging from the anode.

3. The X-ray source of claim 1 wherein the conditioning optics create a focused X-ray beam.

4. The X-ray system of claim 1 wherein the conditioning optics create a parallel X-ray beam.

5. The X-ray system of claim 1 wherein the conditioning optics create an X-ray beam with a predefined divergency.

6. The X-ray source of claim 1 wherein the conditioning optics comprise:

entrance and exit slits and a stop diaphragm that protect the sample from bombardment by the X-rays, other than those reflected from the conditioning optics, the stop diaphragm being positioned before the sample.

7. The X-ray source of claim 6 wherein the slits have an inner surface and the stop diaphragm has an outer surface, the inner surface of the slits and the outer surface of the diaphragm being parallel to an edge of the X-ray beam that impinges thereupon.

8. The X-ray source of claim 1 wherein the X-rays have an energy from 5 keV to 110 keV and are characterized by a shape that varies in cross-section of a parallel beam from 10 microns to 3 millimeters and a focus size down to 10 microns.

9. The X-ray source of claim 1 wherein the linear accelerator accelerates the electron beam emitted from an electron gun up to 15 MeV.

10. The X-ray source of claim 1 wherein the wavelength of the X-rays is up to 200 Angstroms.

11. The X-ray source of claim 1 wherein the wavelength of the X-rays is between 0.1 Angstroms–1.25 Angstroms.

12. A method for using the X-ray source claimed in claim 1, comprising the steps of:

directing the X-rays toward a sample; and analyzing a structure of the sample with a detector, wherein the time required to analyze the structure of the sample is significantly decreased by increasing the flux density of monochromatic x-rays delivered to the sample.

13. A method of generating X-rays comprising the steps of:

providing an X-ray beam from a thin anode having a thickness less than or equal to about 50 microns that is directed along an optical axis;

separating an electron beam from the X-ray beam by an electron trap that deflects and absorbs an electron beam that penetrates through the thin anode; and directing the X-ray beam through conditioning optics to produce a monochromatic, shaped beam having a predetermined energy by cutting off a narrow portion of a continuous spectrum in the region of the spectrum below 110 keV.

* * * * *